US006189729B1

(12) United States Patent
Keller

(10) Patent No.: US 6,189,729 B1
(45) Date of Patent: Feb. 20, 2001

(54) DECORATIVE RIBBON DISPENSER AND METHOD

(75) Inventor: Sheila K. Keller, Oregon City, OR (US)

(73) Assignee: Creative Concepts Unlimited, LLC, Milwaukie, OR (US)

( * ) Notice: Under 35 U.S.C. 154(b), the term of this patent shall be extended for 0 days.

(21) Appl. No.: 09/130,625

(22) Filed: Aug. 6, 1998

(51) Int. Cl.[7] ..... A47K 10/24
(52) U.S. Cl. ..... 221/45; 221/70
(58) Field of Search ..... 221/70, 73, 41, 221/45, 33, 25, 26, 210, 277

(56) References Cited

U.S. PATENT DOCUMENTS 3,698,600 * 10/1972 Foote ..... 221/73
5,691,023 * 11/1997 Keller ..... 428/43
5,806,714 * 9/1998 Geiger ..... 221/70

* cited by examiner

*Primary Examiner*—Kenneth W. Noland
(74) *Attorney, Agent, or Firm*—Kolisch, Hartwell, Dickinson, McCormack & Heuser

(57) ABSTRACT

A dispenser for a roll of decorative ribbon secured removably to a backing strip and having design elements formed at spaced intervals along the length of the ribbon by incomplete cut lines and capable of being separated at said cut lines and bent outwardly from the plane of the ribbon to provide a 3-dimensional ribbon effect, includes a container for the ribbon roll and a housing for the container. The space between the back walls of the container and housing serve to guide movement of the ribbon from the roll upwardly to the top of the container where the ribbon is bent sharply forward and extended through an opening at the back end of the top wall of the container. The bending effects detachment of the design element along its cut lines and causes the design element to project upwardly from the plane of the ribbon. As the ribbon is moved forwardly under the top wall of the container toward the front wall thereof, the upstanding design elements are bent rearward. The ribbon is pulled forwardly through an opening at the front end of the top wall, where the backing strip is separated from the ribbon and directed downwardly through a guide channel at the front end of the housing. The decorative ribbon alternatively may be in the form of decorative stickers secured removably at spaced apart intervals on a backing strip and each having a design element formed therein.

5 Claims, 3 Drawing Sheets

DECORATIVE RIBBON DISPENSER AND METHOD

BACKGROUND OF THE INVENTION

This invention relates to the dispensing of decorative ribbon, and more particularly to the dispensing of the type of decorative ribbon disclosed in my U.S. Pat. No. 5,691, 023.

The decorative ribbon disclosed in my patent aforesaid has an adhesive coated backside covered by a removable protective strip and is characterized by the inclusion of design elements at spaced apart intervals along the ribbon that can be bent upward from the plane of the ribbon, to provide a 3-dimensional appearance. This invention is directed to the provision of a method and dispenser by which ribbon may be withdrawn from a roll of ribbon, while simultaneously bending the design elements outward from the plane of the ribbon and removing the protective strip.

Since the prior art does not disclose the ribbon of my patent aforesaid, so also does the prior art not disclose a dispenser for such ribbon.

SUMMARY OF THE INVENTION

The decorative ribbon dispenser and method of this invention utilizes a container for a roll of ribbon having pop-up designs spaced apart along the length of the ribbon, the dispenser including a container having front, top and rear walls and configured such that the free end of the ribbon roll in the container is threaded first up the rear wall, then bent sharply to pop-up the design element present at the bend, thence past under the top wall to bend the design elements against the ribbon, and finally passed through a divider where the ribbon and backing strip are separated, thereby dispensing a segment of ribbon without backing strip and with pop-up design elements projecting outwardly from the ribbon.

It is the principal objective of this invention to provide a method and dispenser for dispensing decorative ribbon having pop-up design elements spaced apart along the length of the ribbon, ready for applying to a gift package.

Another objective of this invention is the provision of a method and dispenser of the class described that serves alternatively to dispense decorative stickers supported at spaced intervals removably on a backing strip and each having a pop-up design element thereon.

A further objective of this invention is to provide a dispenser of the class described that is of simplified construction for economical mass production.

The foregoing and other objects and advantages of this invention will appear from the following detailed description, taken in connection with the accompanying drawings of a preferred embodiment.

DESCRIPTION OF THE PREFERRED EMBODIMENT

The drawings illustrate the dispenser of this invention adapted specifically for use with a roll 10 of decorative ribbon 12 having decorative design elements 14 formed at spaced intervals along the length of the ribbon, in accordance with the teachings of my earlier U.S. Pat. No. 5,691, 023 aforesaid. The design elements are formed by incomplete cut lines through the ribbon, but not through the underlying protective backing strip 16 that covers the adhesive on the underside of the ribbon.

Figure 1:
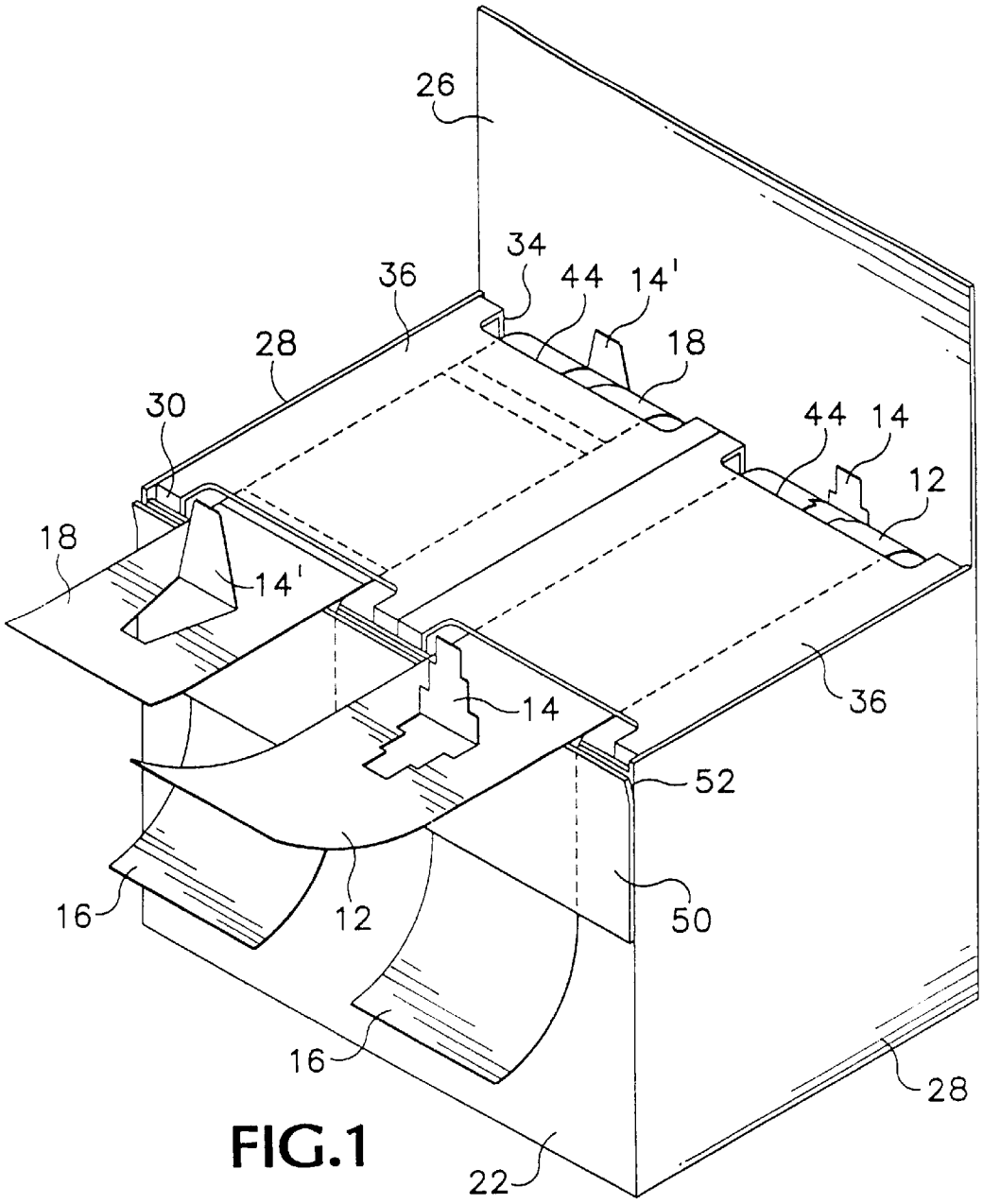
FIG. 1 is a perspective front view of a decorative ribbon dispenser embodying the features of this invention.
Figure 2:
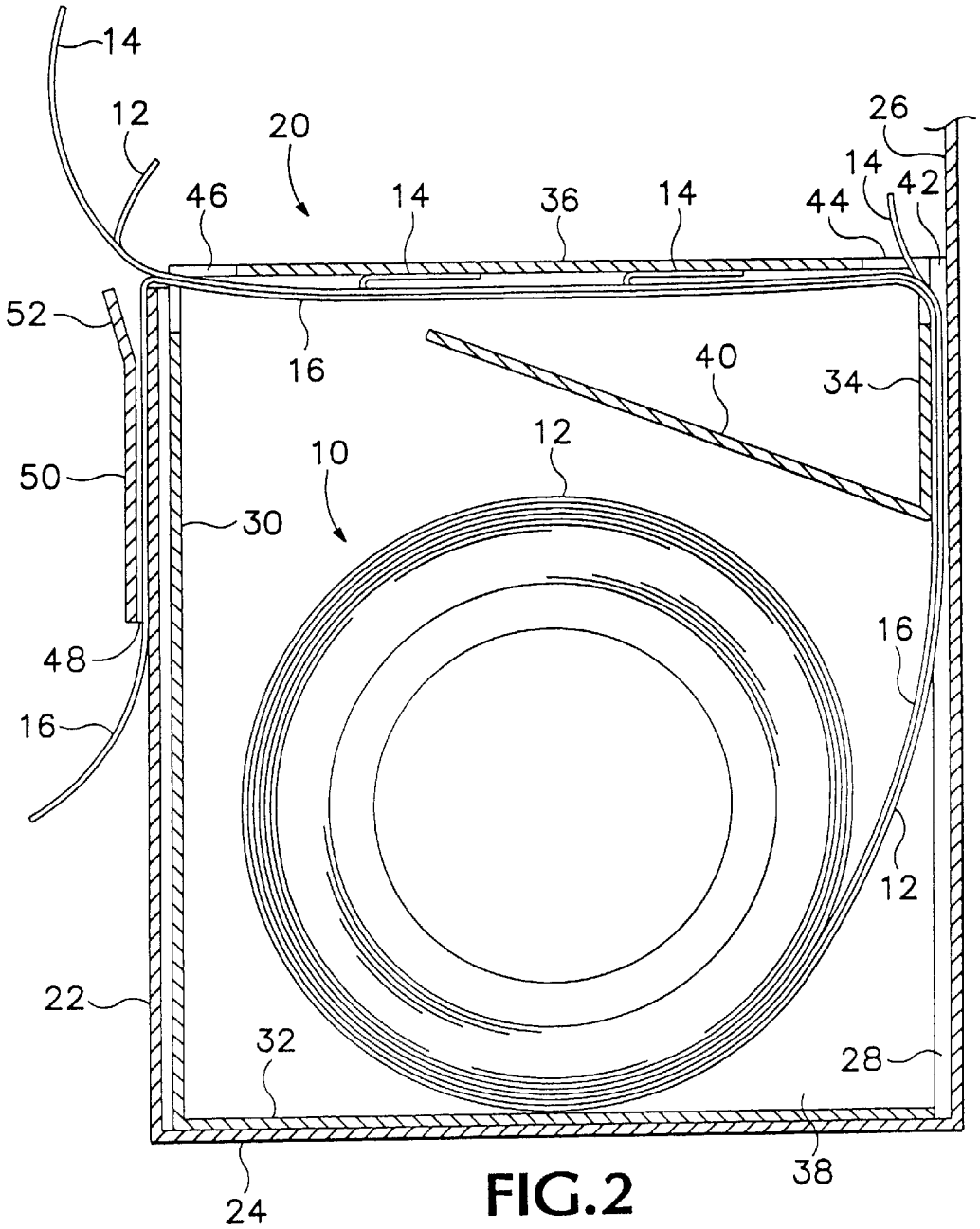
FIG. 2 is a sectional view taken on the line 2—2 in FIG. 1.
Figure 3:
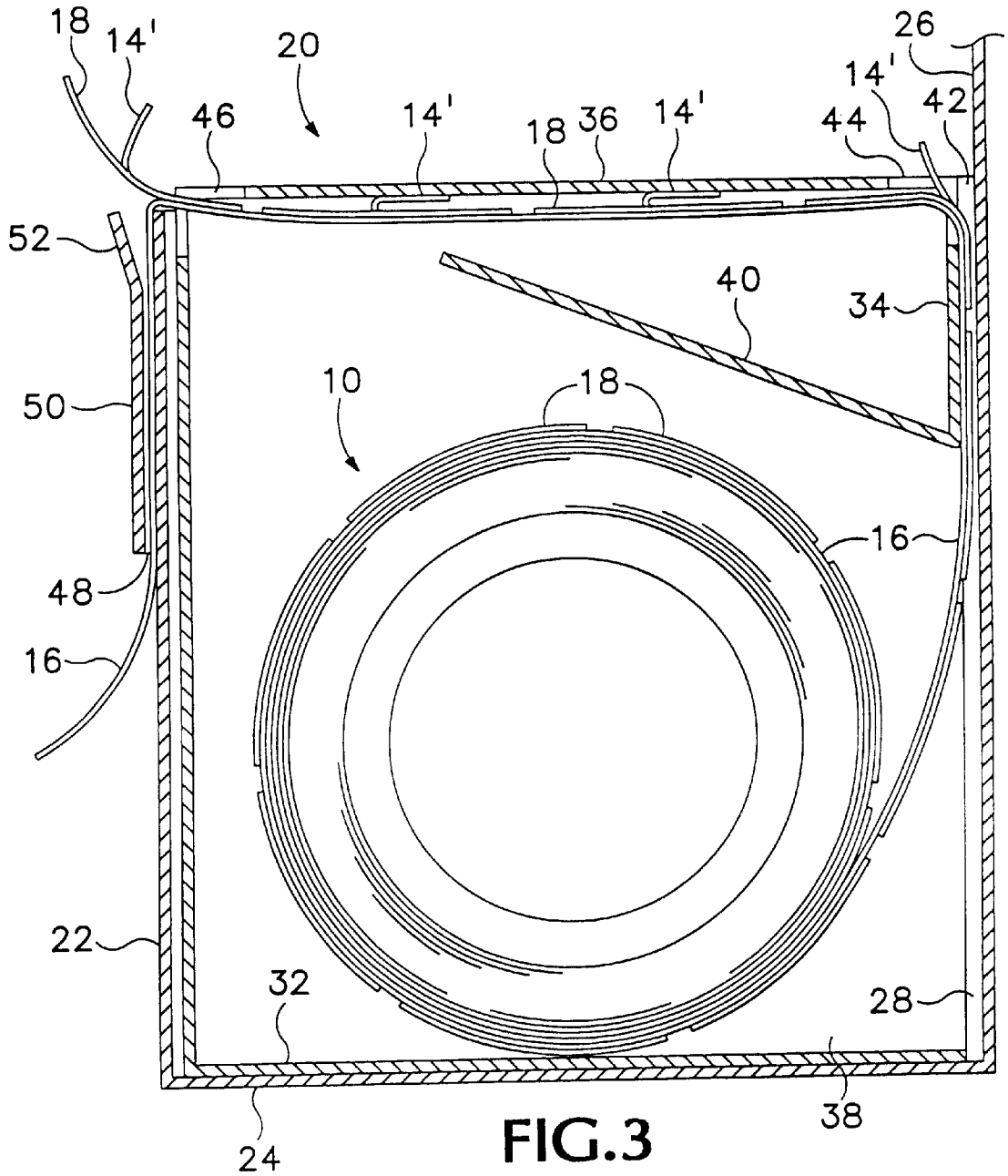
FIG. 3 is a sectional view taken on the line 3—3 in FIG. 1.

The ribbon may be a continuous strip, as shown in FIG. 2, or it may be decorative stickers 18 spaced apart along the length of the backing strip, as shown in FIG. 3.

The dispenser 20 includes a housing defined by front wall 22, bottom wall 24, back wall 26 and side walls 28. The top is open to afford removable installation of a ribbon roll container defined by front wall 30, bottom wall 32, back wall 34, top wall 36 and side walls 38.

A baffle 40 extends angularly inward and upward from the back wall 34 of the roll container to isolate the ribbon roll 10 from the top wall 36. The back wall 34 is spaced slightly inward from the back wall 26 of the housing, forming a guide channel 42 for threading ribbon upwardly therethrough from the roll 10.

A back opening 44 is formed at the juncture between the back wall 34 and top wall 36. As the ribbon is bent sharply forward at the bending station defined by opening 44 to extend forwardly under the top wall 36, the design element 14 is separated from the ribbon along the interrupted cut lines and projects upwardly from the ribbon. As the ribbon is pulled forwardly under the top wall 36 the upstanding design element 14 engages the front edge of the opening 44 and is bent rearward under the top wall.

A front opening 46 is formed at the juncture between the top wall 36 and front wall 30 for extension therethrough of the ribbon 12. At this separating station the backing strip 16 is separated from the ribbon 12, by hand manipulation, and is threaded downward through a guide channel 48 formed between the front wall 22 of the housing and a front panel 50 secured to the front wall. An upper section 52 of the front panel is hinged thereto to swing outward and enlarge the entrance of the channel 48, to facilitate threading the backing strip 16 downwardly through The dispenser described above affords the separation of any desired length of ribbon 12 from the backing strip 16 while simultaneously effecting the projection of the associated number of design elements 14 outwardly from the ribbon. When the desired length of ribbon has been withdrawn through front opening 46 it may be severed for subsequent application to a package to be decorated. A subsequent length of ribbon may be withdrawn from the roll 10 by pulling downward on the backing strip 16 projecting from the lower end of the guide channel 48.

It will be apparent that the roll container may be used to package a roll 10 of ribbon for marketing, and that the housing may receive a plurality of roll containers, one at a time, to dispense ribbon therefrom.

FIG. 3 shows the dispensing of decorative stickers 18 that are secured removably at spaced apart positions on a backing strip 16. As each sticker is drawn upwardly through the back guide channel 42 and is bent sharply to pass forwardly under the top wall 36, the design element 14' is projected upwardly from the sticker, then bent rearward over the sticker as it passes forwardly under the top wall 36, and finally is separated from the backing strip 16 at the front opening 46, in the same manner as the continuous ribbon 12 described hereinbefore.

It will be apparent to those skilled in the art that various changes may be made in the size, shape, type, number and arrangement of parts described hereinbefore, without departing from the spirit of this invention and the scope of the appended claims.

I claim:

1. A dispenser for a roll of decorative ribbon, the decorative ribbon being secured removably to a backing strip and having a design element formed therein by an incomplete cut line and capable of being bent outwardly of the plane of the ribbon, the dispenser comprising:

a) a container for the roll of decorative ribbon, the container having front, back, top and bottom walls, b) guide means for guiding movement of the ribbon in an outfeed direction, c) deflecting means for bending the ribbon during said movement from said guide means to effect offsetting the design element outwardly from the plane of the ribbon, said deflecting means including an opening at a juncture between the top wall and the back wall of the container, and d) separating means for separating the ribbon from the backing strip during said movement of the ribbon from said deflecting means.

2. The dispenser of claim 1 including guide channel means adjacent said front wall for guiding the backing strip away from said separating means opening.

3. The dispenser of claim 1 wherein the guide means comprises a guide slot adjacent said back wall.

4. The dispenser of claim 1 including a housing having front and back walls and an open top and configured to removable receive said container therein with the front and back walls of the container facing the front and back walls of the housing.

5. The dispenser of claim 1 including a housing having front and back walls and an open top and configured to removably receive said container therein with the front and back walls of the container facing the front and back walls of the housing, the space between the back walls forming a guide for movement of the ribbon in the forward direction, and a front panel on the front wall of the housing forming a guide channel there between for guiding a backing strip away from the separating means opening.

* * * * *